US010166806B2

(12) United States Patent
Niu et al.

(10) Patent No.: US 10,166,806 B2
(45) **Date of Patent: *Jan. 1, 2019**

(54) COATED PRINT MEDIUM

(71) Applicant: Hewlett-Packard Development Company, L.P., Fort Collins, CO (US)

(72) Inventors: Bor-Jiunn Niu, San Diego, CA (US); Silke Courtenay, San Diego, CA (US); John Gardner, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/519,763

(22) PCT Filed: Dec. 24, 2014

(86) PCT No.: PCT/US2014/072353

§ 371 (c)(1),
(2) Date: Apr. 17, 2017

(87) PCT Pub. No.: WO2016/105413

PCT Pub. Date: Jun. 30, 2016

(65) Prior Publication Data

US 2017/0326895 A1 Nov. 16, 2017

(51) Int. Cl.
*B41M 5/50* (2006.01)
*B41M 5/52* (2006.01)
(Continued)

(52) U.S. Cl.
CPC ..... *B41M 5/5245* (2013.01); *B41J 2/01* (2013.01); *B41J 11/0015* (2013.01); *B41M 5/52* (2013.01);
(Continued)

(58) Field of Classification Search
CPC .... B41M 5/52; B41M 5/5218; B41M 5/5245; B41M 5/5254; B41J 2/01; B41J 11/0015
See application file for complete search history.

(56) References Cited

U.S. PATENT DOCUMENTS 3,475,190 A 10/1969 Fischer et al.
3,477,866 A 11/1969 Remer
(Continued)

FOREIGN PATENT DOCUMENTS

CN 103003492 3/2013
CN 103442898 12/2013
(Continued)

OTHER PUBLICATIONS

International Search Report dated Sep. 23, 2015 for PCT/US2014/072353, Applicant Hewlett-Packard Development Company, L.P.
(Continued)

*Primary Examiner* — Betelhem Shewareged
(74) *Attorney, Agent, or Firm* — Thorpe North & Western LLP

(57) ABSTRACT

The present disclosure is drawn to a coated print medium, a method of preparing a print medium, and a printing system. The coated print medium can comprise a substrate and a coating applied to the substrate. The coating can comprise, by solids or dry weight, 5 wt % to 30 wt % of a polymeric binder, 20 wt % to 50 wt % of a cationic latex, 5 wt % to 15 wt % of a multivalent cationic salt, and 1 wt % to 20 wt % of a sulfonic acid- or sulfonate-containing stilbene optical brightener.

20 Claims, 1 Drawing Sheet

(51) Int. Cl.
*B41J 2/01* (2006.01)
*B41J 11/00* (2006.01)

(52) U.S. Cl.
CPC ..... *B41M 5/5236* (2013.01); *B41M 5/5254* (2013.01); *B41M 5/5218* (2013.01); *B41M 5/5227* (2013.01); *B41M 2205/34* (2013.01)

(56) References Cited

U.S. PATENT DOCUMENTS

| | | | | |
|---|---|---|---|---|
| 4,025,507 | A | 5/1977 | Fleck et al. | |
| 5,106,420 | A | 4/1992 | Marshall, Jr. | |
| 6,030,443 | A | 2/2000 | Bock et al. | |
| 6,077,642 | A | 6/2000 | Ogata et al. | |
| 6,677,005 | B2 | 1/2004 | Kaneko et al. | |
| 8,765,852 | B1 | 7/2014 | Swei et al. | |
| 9,962,984 | B2 * | 5/2018 | Niu | B41M 5/52 |
| 9,981,497 | B2 * | 5/2018 | Niu | B41M 5/52 |
| 2005/0003114 | A1 * | 1/2005 | Nakano | B41M 5/52 428/32.34 |
| 2005/0031806 | A1 | 2/2005 | Kim et al. | |
| 2005/0161184 | A1 | 7/2005 | Scheffler et al. | |
| 2005/0186331 | A1 | 8/2005 | Fujimoto et al. | |
| 2005/0233097 | A1 | 10/2005 | Tojo et al. | |
| 2006/0260774 | A1 | 11/2006 | Rodriguez et al. | |
| 2008/0075869 | A1 | 3/2008 | Nelli | |
| 2008/0289786 | A1 | 11/2008 | Koenig et al. | |
| 2009/0123675 | A1 | 5/2009 | Shaw-Klein et al. | |
| 2009/0165977 | A1 | 7/2009 | Huang et al. | |
| 2009/0297738 | A1 | 12/2009 | Song et al. | |
| 2009/0317549 | A1 | 12/2009 | Tan et al. | |
| 2010/0129553 | A1 | 5/2010 | Jackson et al. | |
| 2010/0173239 | A1 | 7/2010 | Iftime et al. | |
| 2010/0231670 | A1 | 9/2010 | Arai et al. | |
| 2011/0015111 | A1 | 1/2011 | Yu et al. | |
| 2011/0032551 | A1 | 2/2011 | Faber et al. | |
| 2011/0045313 | A1 | 2/2011 | Gore et al. | |
| 2011/0151149 | A1 | 6/2011 | Koenig | |
| 2011/0240242 | A1 | 10/2011 | Koenig et al. | |
| 2011/0274856 | A1 | 11/2011 | Koenig et al. | |
| 2011/0281042 | A1 | 11/2011 | Wild | |
| 2012/0019587 | A1 | 1/2012 | Koenig | |
| 2012/0048493 | A1 | 3/2012 | Sealey | |
| 2012/0080156 | A1 | 4/2012 | Laleg et al. | |
| 2012/0107531 | A1 | 5/2012 | Idei et al. | |
| 2012/0127509 | A1 | 5/2012 | Faber | |
| 2012/0288645 | A1 | 11/2012 | Zhou et al. | |
| 2012/0328802 | A1 | 12/2012 | Acjatz et al. | |
| 2013/0089683 | A1 | 4/2013 | Cormier et al. | |
| 2013/0164515 | A1 | 6/2013 | Song et al. | |
| 2013/0176371 | A1 | 7/2013 | Nagoshi et al. | |
| 2013/0189457 | A1 | 7/2013 | Skaggs et al. | |
| 2013/0266746 | A1 | 10/2013 | Huang et al. | |
| 2014/0142305 | A1 | 5/2014 | Klein et al. | |
| 2014/0220323 | A1 | 8/2014 | Koenig | |
| 2014/0335367 | A1 | 11/2014 | Tan et al. | |

FOREIGN PATENT DOCUMENTS

| | | |
|---|---|---|
| CN | 103987527 | 8/2014 |
| DE | 112013000632 | 10/2014 |
| EP | 1092554 | 4/2001 |
| EP | 1116597 | 7/2001 |
| EP | 1688539 | 8/2006 |
| EP | 2762534 | 8/2014 |
| GB | 1020301 | 2/1966 |
| WO | 0068021 | 11/2000 |
| WO | 2014014453 | 1/2014 |
| WO | 2014146798 | 9/2014 |

OTHER PUBLICATIONS

Hentzschel et al., Improving the printability of ink jet papers by means of polyvinyl alcohol and other components, Wochenblatt fur Papierfabrikation, 124.18: 795-801. Deutscher fachverlag, 1996.

Ruiping et al., Effects of fluorescence brightening agent carrier on improving the brightness stability of coating paper, Journal of Nanjing Forestry University, 36.1, Jan. 2012, 115-18.

Shi et al., Review: Use of Optical Brightening Agents (OBAs) In the Production of Paper Containing High-Yield Pulps, BioResources, 2012, 7(2), 2582-2591.

Zhang et al., Retention of Optical Brightening Agents (OBA) and their Brightening Efficiency on HYP-Containing Paper Sheets, Journal of Wood Chemistry and Technology, vol. 27, Issue 3-4, 2007.

* cited by examiner

COATED PRINT MEDIUM

BACKGROUND

There are several reasons that inkjet printing has become a popular way of recording images on various media surfaces, particularly paper. Some of these reasons include low printer noise, variable content recording, capability of high speed recording, and multi-color recording. Additionally, these advantages can be obtained at a relatively low price to consumers. However, though there has been great improvement in inkjet printing, accompanying this improvement are increased demands by consumers in this area, e.g., higher speeds, higher resolution, full color image formation, increased stability, etc. Additionally, inkjet printing technology is becoming more prevalent in high speed commercial printing markets. Regardless of the platform, particularly when printing with dye-based inkjet inks, achieving or maintaining a high optical density as well as retaining reduced bleed can be challenging. Coated media typically used for these types of printing can perform somewhat acceptably on these types of inkjet printing devices, but there is still room for improvement as it relates to image quality. As such, research and development of media continue to be sought.

DETAILED DESCRIPTION

Figure 1:
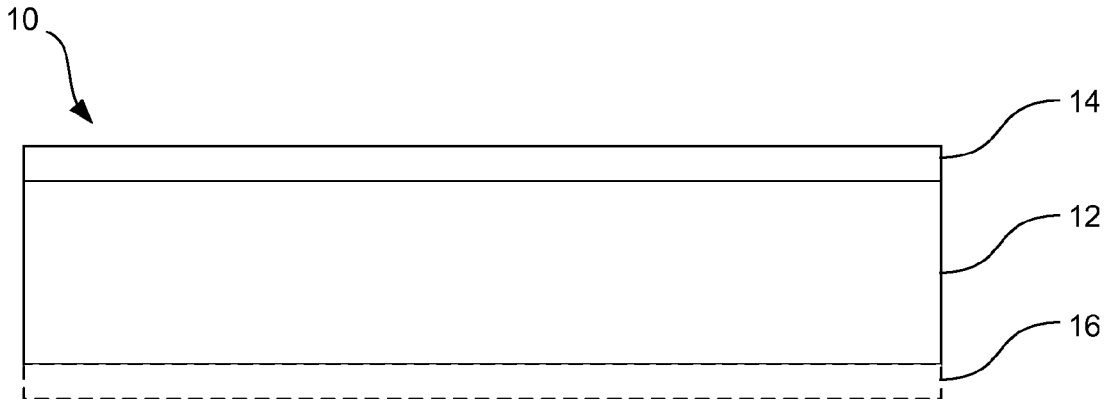
FIG. 1 is a cross-sectional view of a coated print medium in accordance with examples of the present disclosure.

Before the present disclosure is described, it is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

Print quality of dye based inks on uncoated paper can be a challenge because the dyes usually readily penetrate into the paper substrates, resulting in low black optical density. In accordance with the present disclosure, coatings can be applied to various media substrates, including paper, that provide acceptable image quality, including optical density improvement, i.e. increase. More specifically, in combination with polymeric binder, cationic latex, and multivalent cationic salt, the addition of certain types of optical brightener can further improve optical density of dye-based black inkjet inks. In some circumstances, such formulations can thus be used to replace conventional sizing coatings used more traditionally on plain papers and other media substrates. In further detail, black optical density (KOD) can be relatively low for typical paper coatings. In certain examples of the present disclosure, KOD can be increased from 1.3 or lower to greater than 1.3, or even greater than 1.35 or 1.4, for many dye-based black inkjet inks. An additional improvement that can be generated by these formulations can include reducing black line bleed (raggedness) from 30 μm or greater to 25 μm or less (with a lower number indicating less linear bleed, and thus, an indication of bleed improvement). These units can be measured by QEA Personal Image Analysis System from Quality Engineering Associates, Inc., MA, USA. As a result, the formulations of the present disclosure can lead to improved overall image quality.

In accordance with this, the present disclosure is drawn to a print medium including a substrate and a coating applied to the substrate, either on one side or on both sides of the substrate. The coating can include, by solids content (dry weight), 5 wt % to 30 wt % of a polymeric binder such as a starch, polyvinyl alcohol, polyvinyl pyrrolidone, protein, and/or low Tg (i.e. −20° C. to less than 20° C.) latex; 20 wt % to 50 wt % of a cationic latex; 5 wt % to 15 wt % of a multivalent cationic salt; and 1 wt % to 20 wt % of a sulfonic acid- or sulfonate-containing stilbene optical brightener. In one example, the coating can further include from 1 wt % to 20 wt % of hollow-core latex particles. In another example, the coating can include from 5 wt % to 35 wt % of an anionic or cationic calcium carbonate pigment or clay.

In another example, a method of preparing a print medium can include applying a coating to a substrate. The coating can be applied, for example, at from 0.5 gsm to 10 gsm on one or both sides of the substrate. The coating can include, by solids content (dry weight), 5 wt % to 30 wt % of a polymeric binder such as a starch, polyvinyl alcohol, polyvinyl pyrrolidone, protein and/or low Tg latex; 20 wt % to 50 wt % of a cationic latex; 5 wt % to 15 wt % of a multivalent cationic salt; and 1 wt % to 20 wt % of a sulfonic acid- or sulfonate-containing stilbene optical brightener. In one example, the coating can further include from 1 wt % to 20 wt % of hollow-core latex particles and/or from 5 wt % to 35 wt % of an anionic or cationic calcium carbonate pigment or clay.

In another example, a printing system includes a dye-based ink and print medium. The print medium can include a coating applied to one or both sides of a substrate. The coating can include, by solids content (dry weight), 5 wt % to 30 wt % of a polymeric binder such as a starch, polyvinyl alcohol, polyvinyl pyrrolidone, protein and/or low Tg latex, 20 wt % to 50 wt % of a cationic latex; 5 wt % to 15 wt % of a multivalent cationic salt; and 1 wt % to 20 wt % of a sulfonic acid- or sulfonate-containing stilbene optical brightener. In one example, the coating can be applied at from 0.5 to 10 gsm. In other examples, the coating can further include from 1 wt % to 20 wt % of hollow-core latex particles and/or from 5 wt % to 35 wt % of an anionic or cationic calcium carbonate pigment or clay.

In these examples, it is noted that when discussing the coated print medium, the method of making the same, or the printing system, each of these discussions can be considered applicable to each of these examples, whether or not they are explicitly discussed in the context of that example. Thus, for example, in discussing details about the coated print medium per se, such discussion also refers to the methods described herein, and vice versa.

As mentioned, the formulations of the present disclosure can provide several image quality characteristics that are beneficial, particularly for dye-based inkjet ink sets, particularly those including black inkjet inks. Those include generally improved print quality, higher KOD, reduced black line bleed, and versatility of use, e.g., more universal for dye-based and pigmented-based ink systems.

Turning now to FIG. 1, a coated print medium 10 is shown, which can include a coating applied to one 14 or both 14,16 sides of a substrate 12. The coating weight can range from 0.5 gsm to 10 gsm, or in other examples, from 1 gsm to 6 gsm, or from 1.5 gsm. To 4 gsm. Thus, the print medium, method of preparing the print medium, and the printing system can each include a substrate with the coating applied thereto. The substrate is typically a base or foundational material or coated medium, e.g., in the form of a sheet, roll, etc., that is coated in accordance with examples of the present disclosure. The substrate can be, without limitation, a polymer substrate, a conventional paper substrate, a photobase substrate, an offset coated media substrate, or the like. As mentioned, in one aspect of the present disclosure, the coatings herein can be applied to substrates that are already pre-coated with another material, such as offset coated media. To illustrate, the substrate can be a raw, pre-coated base having an offset coating applied at from 2 gsm to 40 gsm. Exemplary offset or other coatings that can be present on offset media include media with clay carbonate coatings, precipitated calcium carbonate coatings, calcined clay coatings, silica pigment-based coatings, combinations thereof, or the like.

As a point of clarification, it is noted that certain coatings (or pre-coatings) described herein may already be present as part of a substrates, and these coatings are not the same as formulation coatings primarily discussed in the context of the present disclosure. Offset media or photobase, for example, already include coatings on one or both side of a substrate material (and thus are considered to be part of the "substrate"). The coating formulations of the present disclosure, conversely, are those which are overcoated with respect to the pre-applied coatings, or alternatively, to substrates that are not already pre-coated. Such coatings, i.e. the pre-coating and/or the coating formulation of the present disclosure, can be present on either one side of a media substrate or both.

Turning now more specifically to the coating formulations of the present disclosure, as mentioned, such coatings include, by solids content (dry weight), 5 wt % to 30 wt % of a polymeric binder; 20 wt % to 50 wt % of a cationic latex; 5 wt % to 15 wt % of a multivalent cationic salt; and 1 wt % to 20 wt % of a sulfonic acid- or sulfonate-containing stilbene optical brightener. In one example, the coating can further include from 1 wt % to 20 wt % of hollow-core latex particles and/or from 5 wt % to 35 wt % of an anionic or cationic calcium carbonate pigment or clay. The solids are typically prepared in a liquid vehicle which is evaporated or dried off to leave the coating solids behinds as a dry coating on the substrate. The liquid vehicle, which is usually primarily water or can be only water, typically includes from 25 wt % to 50 wt % of the initial coating formulation. That being stated, the weight percentages listed for the coating composition recite the weights after the liquid vehicle has been dried or evaporated from the coating composition.

Turning now to specific ingredient that can be present in the final coating, the polymeric binder can be used to bind the materials of the coating together, but may also provide other print quality advantages, e.g., provide improved bleed control. In one specific aspect of the present disclosure, the polymeric binder can be a water soluble polymer binder, though this is not required. To illustrate, the polymeric binder can be any hydrophilic or hydrophilic/hydrophobic blend of polymer material that can be used to bind particulates together in accordance with examples of the present disclosure. By "water soluble," it is noted that the polymer binder is typically at least partially water soluble, mostly water soluble (at least 50%), or in some examples, completely water soluble (at least 99%) in the coating composition. Polyvinyl alcohol, polyvinyl pyrrolidone, starch, low Tg latex having a glass transition temperature (Tg) ranging from −20° C. to 20° C., and protein are examples of acceptable water soluble polymer binders that can be used. Examples of starch binders that can be used include Penford® Gums, such as Penford® 280 (hydroxyethylated starch), available from Penford Corporation. Examples of a low Tg latexes that can be used as a binder are the Neocar® latexes, such as Neocar® 2300 (vinyl versatate-containing latex), among others. Examples of a polyvinyl alcohol binders that can be used include Mowiol® PVOH binders, e.g., Mowiol® 4-98 available from Sigma-Aldrich.

Optionally, and in combination with the polymeric binder, a crosslinker or crosslinking agent can also be included in the coating formulations of the present disclosure. Crosslinkers include materials that have crosslinking properties specifically with respect to the water soluble polymer binder used in a given coating composition. Suitable crosslinkers include boric acid, ammonium zirconium carbonate (AZC), potassium zirconum carbonate (KZC), and OCHCHO (glyoxal). More specifically, in some examples, boric acid is an acceptable crosslinker for polyvinyl alcohol, and in other examples, AZC, KZC, and glyoxal are acceptable crosslinkers for proteins and starches. In one example, non-acidic crosslinkers, such as a blocked glyoxal-based insolubilizer (e.g., Curesan® 200 from BASF) can be used to crosslink the water soluble binder, and these are particularly useful when the anionic non-film forming polymer particulates are also being used. Crosslinkers, if present, are usually present at relatively small concentrations in the coating composition, e.g., from 0.01 wt % to 5 wt % of the formulation, and in many instances, the crosslinkers are more typically present at a ratio of 1:100 to 1:4 crosslinker to binder by weight, though these concentrations and ratios are not intended to be limiting.

The cationic latex can range in glass transition temperature from 20° C. to 120° C. in one example, and in another example, the cationic latex can be a high Tg cationic latex ranging from 70° C. to 120° C. Such materials can include materials such as Raycat® 82 from Specialty Polymers, Inc. (acrylic emulsion polymer, solids 40 wt %, pH 4.5, and glass transition temperature 25° C.), Raycat® 29033 (styrene/acrylic copolymer, solids 40 wt %, pH 5.0, and glass transition temperature 77° C.), and Raycat® 78 (polyacrylic emulsion polymer, solids 40 wt %, pH 5.5, and glass transition temperature 114° C.). These exemplary cationic latexes are examples of suitable materials that can be used herein, but it is noted that other materials currently available or available in the future that meet the criteria of being a cationic latex can also be used.

Turning now to the multivalent cationic salt, various types of salts can be used in the media coatings of the present disclosure. Often, the salt can be, for example, calcium chloride, magnesium chloride, calcium bromide, magnesium bromide, calcium nitrate, magnesium nitrate, or aluminum chlorohydrate. These salts can act as crashing agent for pigment-based inkjet inks. Thus this additive can provide versatility to the coated media in that other ingredients can assist in providing improved image quality for dye-based inks, whereas the presence of the multivalent salt can assist with image quality when a pigmented inkjet ink is used.

Optical brighteners are also present, as described briefly above, and can include any of number of optical brighteners that improve black optical density in the formulations described herein. In accordance with examples of the present disclosure, the optical brighteners can be sulfonic acid- or sulfonate-containing stilbene optical brighteners. Specific examples can include disulfonic acid- or disulfonated-stilbenes, a tetrasulfonic acid- or tetrasulfonated-stilbenes, or a hexasulfonic acid- or hexasulfonated-stilbenes (each including derivatives thereof). Specific examples include Tafluonol® SCBP from The Fong Min International Co., Ltd. (4,4'-bis(1,3,5-triazinylamino)stilbene-2,2'-disulfonic acid derivative), Blankophor® TP1160 from Blankophor (sulfonated stilbene derivative), or Leucophor® FTS from Archroma Paper (cationic bis(triazinylamino)stilbene disulfonic acid derivative). Another example is a hexa tetrasulfonated stilbene compound commercially available under the trade name Tinopal® ABP-A from BASF.

Hollow-core particles, sometimes also referred to as hollow plastic pigments can also be included. These hollow core particles can have a positive impact on area fill uniformity. These hollow-core particles can include one or more void(s) within the outer dimension of the particle volume. The hollow-core particles can, for example, have an inner void volume from about 20% to 70%, or about 30% to 60%, even when in a dry condition. In addition, these hollow-core particles can have a diameter from about 0.1 to 10 μm, about 0.1 to 5 μm, and about 0.1 to 2 μm, and a glass transition temperature (Tg) from about 30° C. to 120° C., or from about 60° C. to 120° C.

These hollow-core particles can be derived from chemicals such as, but not limited to, styrene monomers, acrylic monomers, methacrylic monomers, isoprene (e.g., latex), acid monomers, non-ionic monoethylenically unsaturated monomers, polyethylenically unsaturated monomer, and combinations thereof. The acid monomers can include, but are not limited to, acrylic acid, methacrylic acid, and mixtures thereof; and acryloxypropionic acid, methacryloxypropionic acid, acryloxyacetic acid, methacryloxyacetic acid, and monomethyl acid itaconate. The non-ionic monoethylenically unsaturated monomers can include, but are not limited to, styrene and styrene derivatives (e.g. alkyl, chloro- and bromo-containing styrene), vinyltoluene, ethylene, vinyl esters (e.g. vinyl acetate, vinylformate, vinylacetate, vinylpropionate, vinylbenzoate, vinylpivalate, vinyl 2-ethylhexanoate, vinyl methacrylate, vinyl neodecanoate, and vinyl neononanoate), vinyl versatate, vinyl laurate, vinyl stearate, vinyl myristate, vinyl butyrate, vinyl valerate, vinyl chloride, vinyl idene chloride, acrylonitrile, methacrylonithle, acrylamide, methacrylamide, t-butylacrylamide, t-butyl methacrylamide, isopropylarylamide, isopropylmethacrylamide, and C1-C20 alkyl or $C_3$-$C_2$o alkenyl esters of methacrylic acid or acrylic acid, hydroxyethylacrylate, hydroxyethylmethacrylate, hydroxypropylacrylate, hydroxypropylmethacrylate, and 2,3-dihydroxypropyl methacrylate, etc. Polyethylenically unsaturated monomers can include, but are not limited to, ethylene glycol dimethacrylate, ethylene glycol diacrylate, allyl acrylate, allyl methacrylate, 1,3-butane-diol dimethacrylate, 1,3-butanediol diacrylate, diethylene glycol dimethacrylate, diethylene glycol diacrylate, trimethylol propane trimethacrylate, or divinyl benzene. In particular, the hollow-core particles can include, but are not limited to, an acrylic or styrene acrylic emulsion, such as Ropaque® Ultra, Ropaque® HP-543, Ropaque® HP-643, Ropaque® AF-1055, or Ropaque® OP-96 (available from Rohm and Haas Co. (Philadelphia, Pa.)) or carboxylated styrene/acrylate copolymers, e.g., Dow plastic pigment HS 2000NA, Dow plastic pigment 3000NA, carboxylated styrene/butadiene copolymer, e.g., Dow Latex HSB 3042NA (available from Dow Chemical Co. (Midland, Mich.)).

Other additives can also be present such as cationic or anionic inorganic pigments. For example, the inorganic pigments can be added at from 5 wt % to 35 wt %, by solids content (dry weight). Examples of such inorganic pigments include anionic calcium carbonate, cationic calcium carbonate, or clay. Examples of calcium carbonates that can be used include Hydrocarb® 60, from Omya North America, which is an anionic calcium carbonate; Micronasize® CAT, from Specialty Products, Inc., which is a cationic calcium carbonate; and Ultralube® D-806, which is a calcium carbonate pigment, from Keim Additec Surface GmbH.

Slip aids can also be included that contribute to abrasion resistance and coefficient of friction (COF) reduction. High density polyethylene type waxes are suitable slip aids. Commercially available slip aids that can be used include Michemshield® 29235 from Michelman, Inc., and Ultralube® E846 from Keim Additec Surface GmbH, for example. Lubricants, thickeners, biocides, defoamers, buffering agents, CMS, and surfactants can also be added in minor amounts as well, e.g., from 0.01 wt % to 5 wt %. Fillers can also be included in minor amounts, e.g., from 0.01 wt % to 5 wt %, including materials such as clays, barium sulfate, titanium dioxide, silica, aluminum trihydrate, aluminum oxide, boehmite, and combinations thereof. Again, these materials are optional and considered fillers, and if added, should not detract from the functional characteristics of the coating formulation as a whole.

Figure 2:
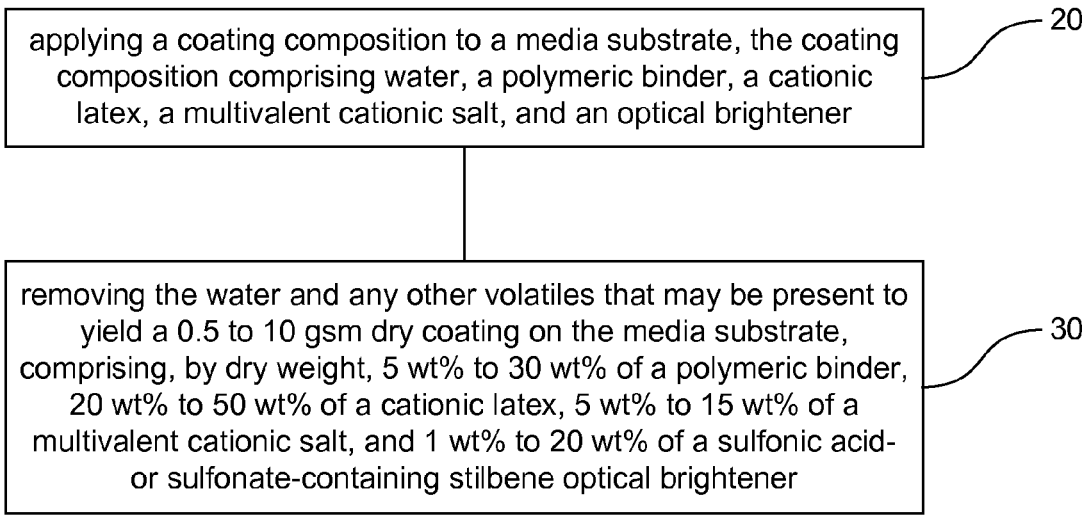
FIG. 2 is a flow chart representation of a method in accordance with examples of the present disclosure.

Once the formulation is prepared, the coating can be applied to the substrate by any of a number of coating methods. Thus, turning now to FIG. 2, in examples of the present disclosure, a method of preparing a print medium, including applying 20 a coating composition to a media substrate. The coating composition can include water, a polymeric binder, a cationic latex, a multivalent cationic salt, and a sulfonic acid- or sulfonate-containing stilbene optical brightener. The method can further include the step of removing 30 the water and any other volatiles that may be present to yield a 0.5 to 10 gsm dry coating on the media substrate. The dry coating can include 5 wt % to 30 wt % of a polymeric binder, 20 wt % to 50 wt % of a cationic latex, 5 wt % to 15 wt % of a multivalent cationic salt, and 1 wt % to 20 wt % of a sulfonic acid- or sulfonate-containing stilbene optical brightener.

In accordance with examples of the present disclosure, the substrate can be coated by spray coating, dip coating, cascade coating, roll coating, gravure coating, curtain coating, air knife coating, cast coating, Mayer rod coating, blade coating, film coating, metered size press coating, puddle size press coating, calender stack, and/or by using other known coating techniques. The thickness selected for each coated layer can depend upon the particular desired property or application. However, an advantage of the formulations of the present disclosure is that they can be applied relatively thinly compared to many other commercially available coating compositions. To illustrate, in one example, the coating can be applied at a coat weight from 0.5 gsm to 10 gsm. In another example, the coating can be applied to the substrate at a coat weight from 1 gsm to 6 gsm. More typical coat weights for comparative media that does not include the components of the present disclosure are usually in the order of about 15 gsm or greater, so a thinner coating with high whiteness, acceptable bleed control, and smudge resistance can be particularly advantageous.

It is noted that, as used in this specification and the appended claims, the singular forms "a," "an," and "the" include plural referents unless the content clearly dictates otherwise.

"Substrate" or "media substrate" includes any base material that can be coated in accordance with examples of the present disclosure, such as film base substrates, polymer substrates, conventional paper substrates, photobase substrates, offset media substrates, and the like. Further, precoated and film coated substrates can be considered a "substrate" that can be further coated in accordance with examples of the present disclosure.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

EXAMPLES

The following examples illustrate some of the coated media substrates, systems, and methods that are presently known. However, it is to be understood that the following are only exemplary or illustrative of the application of the principles of the present compositions, systems, and methods. Numerous modifications and alternative compositions, systems, and methods may be devised by those skilled in the art without departing from the spirit and scope of the present disclosure. The appended claims are intended to cover such modifications and arrangements. Thus, while the examples have been described above with particularity, the following provide further detail in connection with what are presently deemed to be the acceptable examples.

Example 1

Several coating formulations were prepared in accordance with Tables 1A and 1B below (expressed in parts by weight, dry):

TABLE 1A

| Coating Formulations | Formula 1 Wt % | Formula 2 Wt % | Formula 3 Wt % | Formula 4 Wt % |
|---|---|---|---|---|
| Penford ® Gum 280 (hydroxyethylated starch) | 100 | 22.5 | 22.5 | 22.5 |
| Raycat ® 78 (high Tg, acrylic emulsion cationic latex polymer) | — | 36 | 36 | 36 |
| Hydrocarb ® 60 (anionic $CaCO_3$ pigment) | — | 22.5 | 22.5 | 22.5 |
| $CaCl_2$ (multivalent cationic salt) | — | 9 | 9 | 9 |
| Tafluonol ® SCBP (optical brightener) | — | 10 | — | — |
| Blankophor ® TP1160 (optical brightener) | — | — | 10 | — |
| Leucophor ® FTS (optical brightener) | — | — | — | 10 |

TABLE 1B

| Coating Formulations | Formula 5 Wt % | Formula 6 Wt % | Formula 7 Wt % | Formula 8 Wt % |
|---|---|---|---|---|
| Penford ® Gum 280 (hydroxyethylated starch) | 22.5 | — | — | — |
| Neocar ® 2300 (Low Tg anionic latex) | — | 11.5 | 10.5 | 7 |
| Raycat ® 78 (high Tg, acrylic emulsion cationic latex polymer) | 36 | 65 | 58 | 39 |
| $CaCl_2$ (multivalent cationic salt) | 9 | 11.5 | 10.5 | 6.5 |
| Ultralube ® D-806 ($CaCO_3$ pigment) | — | 11.5 | 10.5 | 7 |
| Mowiol ® 4-98 (Polyvinyl Alcohol; >98% hydrolysis, 27,000 Mw) | — | 0.5 | 0.5 | 0.5 |
| Tafluonol ® SCBP (optical brightener) | — | — | 10 | — |
| Blankophor ® TP1160 (optical brightener) | — | — | — | 10 |
| Leucophor ® FTS (optical brightener) | 10 | — | — | — |
| Micronasize ® CAT (cationic $CaCO_3$ pigment) | 22.5 | — | — | 30 |

Tafluonol ® SCBP - anionic hexa sulfonic acid; 4,4'-bis(1,3,5-triazinylamino)stilbene-2,2'-disulfonic acid derivative.
Blankophor ® TP1160 - anionic sulfonated stilbene derivative.
Leucophor ® FTS - cationic bis(triazinylamino)stilbene disulfonic acid derivative.

These coating formulations can be prepared using various preparative methods, with various liquid vehicles, and adding ingredients using various orders. To illustrate, in one example, the order of addition of ingredients can be water, cationic latex particles, multivalent cationic salt, polymeric binder (starch or low Tg latex in these examples), and optical brighteners and other additives last, for example.

Example 2

The formulations of Tables 1A and 1B can be applied to one side or both sides of a media substrate, such as paper, and dried so that the solvent or liquid vehicle components are removed. It is noted the liquid vehicle in Tables 1A and 1B is not listed because Formulas 1-8 are provided in dry weight. That being stated, the liquid vehicle which is removed by drying can be primarily water with or without other small amounts of other volatile ingredients that can be readily removed upon drying. The remaining dry weight can typically be from 0.5 gsm to 10 gsm. In the present example, coating formulations of Tables 1A and 1B were overcoated on single side of a plain paper print media substrate using a blade coater to produce a dry coating weight of about 1 gsm.

In accordance with this, eight media samples were prepared and the various media samples were then tested for black optical density (KOD), black bleed raggedness (K-line raggedness), and black-yellow bleed raggendness (K-Y bleed raggedness). Coating 1 (C1) represents Formula 1 coated at 1 gsm on single side of a paper media substrate; coating 2 (C2) represents Formula 2 coated at 1 gsm on single side of a paper media substrate; and so forth. P1 is an uncoated paper substrate control for comparison purposes. Dye-based black inkjet ink (and yellow ink where applicable) was then printed on each coating sample using ink from a Ricoh Infoprint 5000 dye-based ink system. With black optical density, a larger number is better indicating more optical density for the dye-based inkjet inks printed thereon. With K-line raggedness and K-Y bleed raggedness, a smaller number is better indicating less bleed outward from a deliberately printed line into an unprinted area (K-line) or a yellow area (K-Y bleed). The data for KOD, K-line raggedness, and K-Y bleed raggedness is provided in Table 2, as follows:

TABLE 2

| | C1 | C2 | C3 | C4 | C5 | C6 | C7 | C8 | P1 |
|---|---|---|---|---|---|---|---|---|---|
| KOD | 1.26 | 1.41 | 1.4 | 1.37 | 1.38 | 1.31 | 1.39 | 1.4 | 1.23 |
| K-line raggedness (μm) | 28.1 | 23.2 | 22.5 | 22.9 | 25.1 | 21.7 | 18.2 | 18.8 | 17.0 |
| K-Y bleed raggedness (μm) | 41 | 25.5 | 27.3 | 30 | 28.5 | n/a | n/a | n/a | 22.8 |

As can be seen in Table 2, C2, C3, C4 and C5 had better optical density, K-line raggedness, and K-Y bleed raggedness compared to a lab coated control C1 (hydrophobically modified starch), and better OD than a commercial uncoated paper control (P1) while maintaining acceptable K-line quality and K-Y bleed. Likewise, C7 and C8 had very good optical density and K-line raggedness compared to C6, which did not contain an optical brightener. In each case, the optical brightener seemed to have an unexpected positive impact on KOD and K-line raggedness. For example, raising the KOD from around 1.3 or 1.31 to around 1.37 or greater is fairly significant improvement. Likewise, reducing K-line raggedness from around 30 μm to around or below 25.1 μm is also a fairly significant improvement as shown in C1-C5, and from around 27.1 μm to around or below 18.8 μm is also a fairly significant improvement as shown in C6-C8.

Example 3

Several alternative coating formulations were prepared in accordance with Tables 3A and 3B below (expressed in parts by weight, dry):

TABLE 3A

| Coating Formulations | Formula 9 Wt % | Formula 10 Wt % | Formula 11 Wt % | Formula 12 Wt % |
|---|---|---|---|---|
| Penford ® Gum 280 (hydroxyethylated starch) | 100 | 25 | 20 | 17.5 |
| Raycat ® 78 (high Tg, acrylic emulsion cationic latex) | — | 40 | 40 | 40 |
| $CaCl_2$ (multivalent cationic salt) | — | 10 | 10 | 10 |
| Ropaque ® AF-1055 (styrene acrylic emulsion hollow-core latex particles) | — | — | 10 | 15 |
| Micronasize ® CAT (cationic calcium carbonate dispersion) | — | 25 | 20 | 17.5 |

TABLE 3B

| Coating Formulations | Formula 13 Wt % | Formula 14 Wt % | Formula 15 Wt % | Formula 16 Wt % | Formula 17 Wt % |
|---|---|---|---|---|---|
| Penford ® Gum 280 (hydroxyethylated starch) | 15 | 25 | 20 | 17.5 | 15 |
| Raycat ® 78 (high Tg, acrylic emulsion cationic latex) | 40 | 40 | 40 | 40 | 40 |
| $CaCl_2$ (multivalent cationic salt) | 10 | 10 | 10 | 10 | 10 |
| Ropaque ® AF-1055 (styrene acrylic emulsion hollow-core latex particles) | 20 | — | 10 | 15 | 20 |
| Micronasize ® CAT (cationic calcium carbonate dispersion) | 15 | — | — | — | — |
| Hydrocarb ® 60 (anionic calcium carbonate dispersion) | — | 25 | 20 | 17.5 | 15 |

Example 4

The formulations of Tables 3A and 3B can be applied to one side or both sides of a media substrate, such as paper, and dried so that the solvent or liquid vehicle components are removed. It is noted the liquid vehicle in Tables 3A and 3B is not listed because Formulas 9-17 are provided in dry weight. That being stated, the liquid vehicle which is removed by drying can be primarily water with or without other small amounts of other volatile ingredients that can be readily removed upon drying. The remaining dry weight can typically be from 0.5 gsm to 10 gsm. In the present example, coating formulations of Tables 3A and 3B were overcoated on single side of a plain paper print media substrate using a blade coater to produce a dry coating weight of about 1 gsm.

In accordance with this, ten media samples (nine coated and one uncoated) were prepared and the various media samples were then tested for black optical density (KOD), megenta optical density (MOD), black bleed raggedness (K-line raggedness), black-yellow bleed raggedness (K-Y bleed raggedness), black-magenta bleed raggedness (K-M bleed raggedness), and Area Fill Uniformity. Coating 9 (C9) represents Formula 9 coated at 1 gsm on single side of a paper media substrate; coating 10 (C10) represents Formula 10 coated at 1 gsm on single side of a paper media substrate; and so forth. P2 is an uncoated paper substrate control for comparison purposes. Dye-based black inkjet ink (and yellow ink where applicable) was then printed on each coating sample using ink from a Ricoh Infoprint 5000 dye-based ink system. With black optical density (KOD) and magenta optical density (MOD), a larger number is better indicating more optical density for the dye-based inkjet inks printed thereon. With K-line raggedness and K-Y bleed raggedness, a smaller number is better indicating less bleed in micrometers outward from a deliberately printed line into an unprinted area (K-line) or a yellow area (K-Y bleed). For Area fill, 1 is the worst possible score whereas 10 is the best possible score. The data for these tests is provided in Table 4, as follows:

TABLE 4

| | C9 | C10 | C11 | C12 | C13 | C14 | C15 | C16 | C17 | P2 |
|---|---|---|---|---|---|---|---|---|---|---|
| KOD | 1.34 | 1.41 | 1.39 | 1.36 | 1.32 | 1.41 | 1.38 | 1.35 | 1.32 | 1.25 |
| MOD | 1.22 | 1.17 | 1.14 | 1.10 | 1.07 | 1.19 | 1.14 | 1.11 | 1.08 | 1.05 |
| K-line raggedness (μm) | 21.2 | 20.2 | 19.7 | 19.3 | 18.3 | 20.1 | 19.5 | 19.3 | 19.1 | 18.4 |
| K-Y bleed raggedness (μm) | 39.2 | 23.9 | 23.9 | 24.9 | 24.3 | 28.6 | 25.4 | 24.4 | 23.8 | 22.9 |
| K-M bleed raggedness (μm) | 43.6 | 27.9 | 26.7 | 25.3 | 24.6 | 29.1 | 28.4 | 27.2 | 25.9 | 24.0 |
| Area Fill Uniformity (1-10) | 1 | 5 | 7 | 9 | 10 | 5 | 7 | 9 | 10 | 5 |

As noted, formulations similar to that shown in Examples 1 and 2 above were provided in Examples 3 and 4, but with the addition of hollow-core latex particles. The addition of these particles provided additional improvement in image quality in terms of area-fill uniformity quantified by both visual grading and by SEM analysis, with a minor trade-off for optical density loss. Black line raggedness and black to color bleed raggedness were improved generally. Similar results were achieved with respect to the addition of optical brightener, comparing formulations against a starch control (F9) and a commercial uncoated control (P2). The formulations prepared in accordance with the present disclosure exhibited generally better black and magenta (KOD and MOD), and better area-fill uniformity while maintaining acceptable bleed. Table 4 also shows that compositions containing a cationic calcium carbonate dispersion (Formula 10-13) or an anionic calcium carbonate dispersion (Formula 14-17) produced similar performance.

While the disclosure has been described with reference to certain examples, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A coated print medium, comprising:

a substrate; and a coating applied to the substrate, comprising, by dry weight:

5 wt % to 30 wt % of a polymeric binder, 20 wt % to 50 wt % of a cationic latex, 5 wt % to 15 wt % of a multivalent cationic salt, and 1 wt % to 20 wt % of a sulfonic acid- or sulfonate-containing stilbene optical brightener.

2. The print medium of claim 1, wherein the substrate is uncoated or precoated and comprises a polymer substrate, a paper substrate, a photobase substrate, a film coated substrate, or an offset media substrate.

3. The print medium of claim 1, wherein the polymeric binder is selected from the group consisting of starch, polyvinyl alcohol, polyvinyl pyrrolidone, −20° C. to 20° C. Tg latex, protein, and combinations thereof.

4. The print medium of claim 1, wherein the cationic latex is a high Tg cationic latex having a glass transition temperature ranging from 70° C. to 120° C.

5. The print medium of claim 1, wherein the multivalent cationic salt is selected from the group of calcium chloride, magnesium chloride, calcium bromide, magnesium bromide, calcium nitrate, magnesium nitrate, aluminum chlorohydrate, and combinations thereof.

6. The print medium of claim 1, wherein the optical brightener is a disulfonic acid- or disulfonated-stilbene, a tetrasulfonic acid- or tetrasulfonated-stilbene, a hexasulfonic acid- or hexasulfonated-stilbene, or a derivative thereof.

7. The print medium of claim 1, wherein the optical brightener is 4,4'-bis(1,3,5-triazinylamino)stilbene-2,2'-disulfonic acid derivative, or cationic bis(triazinylamino)stilbene disulfonic acid derivative.

8. The print medium of claim 1, wherein the coating is applied to the substrate at a coat weight from 0.5 gsm to 10 gsm on a single side or both sides.

9. The print medium of claim 1, the coating further comprising from 1 wt % to 20 wt % of hollow-core latex particles.

10. The print medium of claim 1, the coating further comprising from 5 wt % to 35 wt % of anionic calcium carbonate pigment, cationic calcium carbonate pigment, or clay.

11. A method of preparing a coated print medium, comprising:

applying a coating composition to a media substrate, the coating composition comprising water, a polymeric binder, a cationic latex, a multivalent cationic salt, and an optical brightener; and removing the water and any other volatiles that may be present to yield a 0.5 to 10 gsm dry coating on the media substrate, comprising, by dry weight, 5 wt % to 30 wt % of a polymeric binder, 20 wt % to 50 wt % of a cationic latex, 5 wt % to 15 wt % of a multivalent cationic salt, and 1 wt % to 20 wt % of a sulfonic acid- or sulfonate-containing stilbene optical brightener.

12. The method of claim 11, wherein the dry coating is from 1 gsm to 6 gsm.

13. The method of claim 11, wherein the optical brightener is a disulfonic acid- or disulfonated-stilbene, a tetrasulfonic acid- or tetrasulfonated-stilbene, a hexasulfonic acid- or hexasulfonated-stilbene, or a derivative thereof.

14. A printing system, comprising:

a dye-based inkjet ink;

a coated print medium, comprising:

a substrate;

a coating applied to the substrate, comprising, by dry weight:

5 wt % to 30 wt % of a polymeric binder;

20 wt % to 50 wt % of a cationic latex;

5 wt % to 15 wt % of a multivalent cationic salt; and 1 wt % to 20 wt % of a sulfonic acid- or sulfonate-containing stilbene optical brightener, wherein the dye-based black inkjet ink has an optical density when printed at 100% fill on the coated print medium of at least 1.35.

15. The printing system of claim 14, wherein the coated print medium is coated at a dry coat weight from about 0.5 to 10 gsm.

16. The printing system of claim 14, wherein the polymeric binder is selected from the group consisting of starch, polyvinyl alcohol, polyvinyl pyrrolidone, −20° C. to 20° C. Tg latex, protein, and combinations thereof.

17. The printing system of claim 14, wherein the cationic latex is a high Tg cationic latex having a glass transition temperature ranging from 70° C. to 120° C.

18. The printing system of claim 14, wherein the multivalent cationic salt is selected from the group of calcium chloride, magnesium chloride, calcium bromide, magnesium bromide, calcium nitrate, magnesium nitrate, aluminum chlorohydrate, and combinations thereof.

19. The printing system of claim 14, the coating further comprising from 1 wt % to 20 wt % of hollow-core latex particles.

20. The printing system of claim 14, the coating further comprising from 5 wt % to 35 wt % of anionic calcium carbonate pigment, cationic calcium carbonate pigment, or clay.

* * * * *